United States Patent [19]

Yost et al.

[11] Patent Number: 4,608,793

[45] Date of Patent: Sep. 2, 1986

[54] STRUCTURAL GASKET WALL

[75] Inventors: Wayne R. Yost, Cadillac, Mich.; Lynn Tipton, Houston, Tex.

[73] Assignee: Cadillac Rubber & Plastics, Inc., Cadillac, Mich.

[21] Appl. No.: 535,885

[22] Filed: Sep. 26, 1983

[51] Int. Cl.[4] ..... E04H 1/00

[52] U.S. Cl. ..... 52/235; 52/400; 52/403; 52/475

[58] Field of Search ..... 52/235, 397–400, 52/403, 475, 477, 664, 665

[56] References Cited

U.S. PATENT DOCUMENTS

| | | | |
|---|---|---|---|
| 3,028,938 | 4/1962 | Schorr | 52/400 |
| 3,140,763 | 7/1964 | Edelstein | 52/397 |
| 3,205,630 | 9/1965 | Felix | 52/397 |
| 3,805,470 | 4/1974 | Brown | 52/400 |
| 3,844,077 | 10/1974 | Vance | 52/209 |
| 3,968,608 | 7/1976 | Swango | 52/235 |
| 3,978,629 | 9/1976 | Echols, Sr. | 52/235 |
| 4,141,188 | 2/1979 | Sukolics | 52/395 |
| 4,428,171 | 1/1984 | Harbin | 52/398 |
| 4,453,355 | 6/1984 | Stoakes | 52/235 |

*Primary Examiner*—John E. Murtagh
*Assistant Examiner*—Andrew Joseph Rudy
*Attorney, Agent, or Firm*—Varnum, Riddering, Schmidt & Howlett

[57] ABSTRACT

A structural gasket system for curtain walls and the like in building structures has intersecting mullions with T-shaped outer ends (28, 128, 248) or mullions with enlarged outer ends (328, 358) joined at the intersecting joints, integral elastomeric gasket members (48, 226, 344) surround the outer ends of the mullions, including the T shapes (42, 142, 264) or the enlarged ends (340, 366), and retainers (62, 150, 240, 302, 372) engage each side of the mullions and lock the gasket members to the mullions. The gasket members have laterally-extending inner and outer lips forming channels the width of panels (26). The retainers (62, 150, 240, 302, 372) bear against the inner lips (56, 236, 368) of the gasket members to seal the gasket members to the panel. The structural gasket system can be installed from the inside of the building and insulates the mullions from the outside.

31 Claims, 11 Drawing Figures

STRUCTURAL GASKET WALL

FIELD OF THE INVENTION

This invention relates to walls for building structures in which a plurality of large glass or other sheet material panels are mounted to a structural framework through a structural gasket system to form at least portions of an exterior building wall.

STATE OF THE PRIOR ART

In multistory commercial construction trade, buildings have been recently designed with reflective glass panels which are secured to a structural framework through an elastomeric gasket system. In some buildings, the window glass spans the entire outer wall or walls of the building. Very large window panels are employed and disposed in adjacent coplanar relationship relative to each other. Typically, glass panels are large enough to extend between one or more floors. These panels have significant weight. Gasket systems thus must be adapted to support significant weight. Further, in some areas of the country, gasket systems must be able to retain glass during high wind loading which results in a negative pressure on the leeward side of the building.

Typically, gasket systems comprise a rigid structural framework of mullions and a rubber interface between the glass panels and the mullions. Examples of these systems are described in the following U.S. patents:

Morgann et al—U.S. Pat. No. 2,609,071—issued 9/2/52
Maciunas—U.S. Pat. No. 2,985,263—issued 5/23/61
Horgan, Jr.—U.S. Pat. No. 3,435,579—issued 4/1/69
Nobels et al—U.S. Pat. No. 3,638,385—issued 2/1/72
Brown—U.S. Pat. No. 3,722,161—issued 3/27/73
Dallen—U.S. Pat No. 3,866,374—issued 2/18/75
Wright—U.S. Pat. No. 3,932,974—issued 1/20/76
Stoakes—U.S. Pat. No. Re. 30,432—original issued 3/2/76
Echols, Sr.—U.S. Pat. No. 3,978,629—issued 9/7/76
Vance—U.S. Pat. No. 3,844,077—issued 10/29/74
Sukolics—U.S. Pat. No. 4,141,188—issued 2/27/79

Many of these systems, for example Dallen, Echols, Wright, Horgan, Stoakes and Maciunas, require an inside and outside assembly crew. A scaffolding must be set up and used to complete each section. The scaffolding is then moved to a new location. The movement of the scaffolding takes as long as the installation of the glass. Typically, four people are required for these installations. Thus, the assembly of the outer wall is labor intensive and time consuming for movement of the scaffolding.

It is important to provide a thermal barrier between the outside and inside of the building to prevent unwanted heat transfer along the mullions. The mullions are usually metal and therefore must be covered with a gasket or otherwise insulated. It is preferable to have the outside of the mullion covered with an elastomer to inhibit heat transfer through the mullion. Such structures are provided in Dallen and Brown. In Brown the gaskets are segmented and are held onto the mullion through small re-entrant channels. The gaskets in turn hold the glass panels to the mullion. The small re-entrant channels are believed relatively weak and unable to withstand significant negative pressures. These systems have also been subject to leaking at the corner joints. It appears that the gaskets can be installed entirely from within the building in the Brown system.

The windows must have a tight gasket between the window and the mullion or other structural support to keep out air and moisture. Many systems are custom fabricated on the job (for example, Vance). Construction workers are not skilled in rubber molding and gasket sealing. Quality control is therefore difficult for custom-constructed systems. The result is that there are leaks at the joints of the rubber. It is thus desirable to have as much of a gasket system prefabricated in the factory as possible.

SUMMARY OF THE INVENTION

We have discovered a structural gasket system for a curtain wall or wall portion in which the outer portion of a structural framework is covered with an integral elastomeric gasket system which can be fabricated substantially completely in the factory, yet the gasket is strong and will withstand significant wind forces. Further, the system can be installed from within the building, thereby eliminating the need for an outside crew and for a scaffolding which must be moved from place to place.

The structural gasket system of the invention comprises a rigid structural framework formed by intersecting metal mullions which are joined together at the intersections thereof and secured to the interior fixed structural members. Each of the mullions has a gasket-engaging means at an outer end thereof and a retainer-engaging means inwardly of the outer end thereof. An integral elastomeric gasket member integrally surrounds the outer end of the mullion, including the gasket-engaging means. The gasket member also has laterally-extending inner and outer lips forming channels the width of the panels. Retainer means are provided between each side of the mullion and the gasket. The retainer means have a means to engage and grip the retainer-engaging means on the mullion and are so shaped as to lock the gasket member onto the mullion and to force the gasket inner lip against the panel to seal the gasket to the panel.

The mullions can take several shapes. In one embodiment, the mullions have a T-shaped outer end positioned outside of the panels and a portion of the T extends laterally beyond the edge of the panels. The retainer-engaging means of the mullions comprise laterally-extending flanges at the inner end of the mullion so that the mullions are I-shaped in cross-section.

In another form of the invention, the mullions have an expanded end portion which is coextensive with the panels. The gaskets in this embodiment fit behind the expanded end and are held in such position by the retainer means.

The retainer-engaging means on the mullion and the retainers can also take various shapes. In one embodiment, the retainer-engaging means of the mullion comprises L-shaped flanges which extend rearwardly and laterally extending flanges at the inner end of the mullion. The retainer means is captured between the L-shaped flanges and the laterally extended flanges at the end of the mullion. Preferably, the retainer means and the mullion laterally-extending flanges have inter-engaging means which provide a snap-fit connection therebetween. Further, the retainer means and the inner lip of the gasket member have inter-engaging means to maintain the inner lip of the gasket in its laterally-extending position along the interface of the panel in the gasket-member channels. Desirably, there are multiple sets of L-shaped flanges spaced along the central portion of the mullion to accommodate different thickness panels.

In another embodiment, the retainer-engaging means on the mullion comprise L-shaped flanges extending in an outward direction and the retainer means comprises a first rigid member which extends between at least one of the mullion L-shaped flanges, and preferably between two of said L-shaped flanges, and the gasket member along the mullion, and has a lateral flange spaced from the gasket inner lip. A wedge member having a tapered surface is positioned between the lateral flange of the first rigid member and the inner lip of the gasket to wedge the inner lip of the gasket against the panel. Means are provided for locking the wedge member to the first rigid member. In this embodiment, a cover member is provided to cover the mullion and the retainer and inter-engaging means are provided between the cover member, the mullion and the retainer means to lock the cover member to the mullion.

In another embodiment, the retainer-engaging means comprises threaded screw-retaining flanges in a central portion of the mullion. Threaded fasteners extend through the retainer means and engage the threaded screw-retaining flanges to hold the retainer onto the mullion and in bracing relationship against the gasket member.

In the event that a double glazed panel is used, weep holes are provided in the gasket member along horizontal portions of the gasket system to drain moisture which may accumulate between the panels.

BRIEF DESCRIPTION OF THE DRAWINGS

The invention will now be described with reference to the accompanying drawings in which like numerals are used to designate like parts and in which.

BEST MODES FOR CARRYING OUT THE INVENTION

Figure 1:
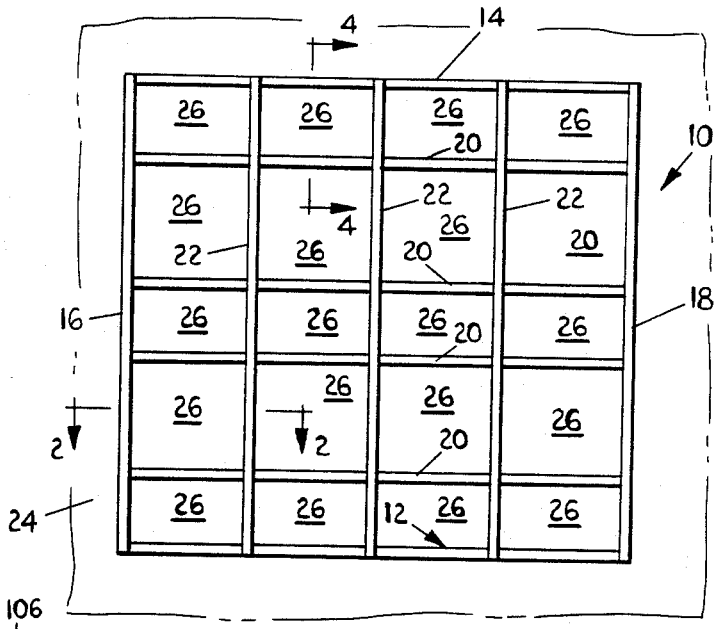
FIG. 1 is a front elevational view of a structural gasket walls according to the invention.

Referring now to the drawings and to FIG. 1 in particular, there is shown a front elevational view of a building wall 10 having a building frame 24 which surrounds a structural gasket wall according to the invention. The gasket wall has a bottom gasket assembly 12, a top gasket assembly 14, a left jamb assembly 16 and a right jamb assembly 18. A number of interior horizontal gasket assemblies 20 and interior vertical gasket assemblies 22 form a grid pattern within the bottom, top, left jamb and right jamb gasket assemblies 12, 14, 16 and 18 respectively. Glass panels 26 are held within the grid system formed by the gasket assembly.

Figure 2:
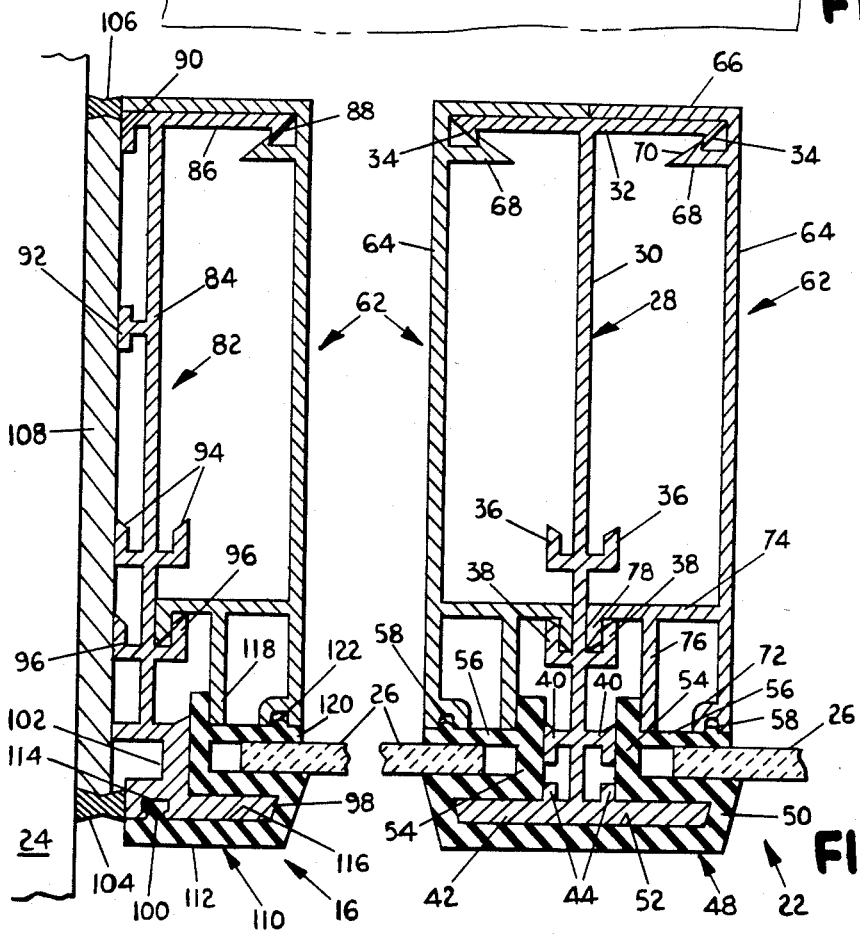
FIG. 2 is a partial sectional view of the wall of FIG. 1 taken along lines 2—2 of FIG. 1.

Referring now to FIG. 2, there is shown a sectional view through the left jamb gasket assembly 16 and one of the interior vertical gasket assemblies 22. The right jamb gasket assembly 18 would be identical with the gasket assembly 16 except would be a mirror image thereof. For this reason, only the left jamb assembly will be described.

The interior vertical gasket assembly 22 comprises a vertical inside mullion 28, a rubber gasket member 48 and a cover retainer 62. The vertical inside mullion 28 has a central web portion 30 with lateral end portions 32 extending outwardly and terminating in inwardly directed barbs 34. L-shaped retaining flanges 36 and 38 and L-shaped bracing flanges 40 are spaced along the central web 30 toward the outer end thereof. A lateral reinforcing end flange 42 with inwardly directed reinforcing corner flanges 44 is formed at the outer end of the vertical mullion 28. Thus, it can be seen that the vertical mullion 28 is I-shaped in configuration with retaining and reinforcing flanges spaced along the central web thereof.

The rubber gasket member 48 has a flat body portion 50 forming an interior cavity 52, inwardly directed flanges 54 and laterally directed flanges 56 with a raised bead 58 near the outer end thereof. The body portion 50 and the laterally directed flange 56 form a U-shaped channel for glass panels 26. The cavity 52 is shaped to fit the lateral reinforcing end flange 42. The inwardly directed flanges 54 are spaced apart and braced by the reinforcing corner flanges 44 and the L-shaped bracing flanges 40 of the vertical inside mullion 28.

The cover retainer 62 has a rewardly-extending wall 64 with a lateral inner wall 66 and a retaining flange 68 with a hook portion 70 at one end thereof. The hook portion 70 of the cover retainer 62 is retained behind the inwardly directed barb 34 of the mullion 28. The cover retainer 62 further has at the other end an L-shaped flange 72 which fits over the bead 58 on the laterally directed flange 56 of the rubber gasket 48. The cover retainer 62 further has a lateral interior flange 74 with a depending bracing flange 76 and a depending retainer flange 78. The depending retainer flange 78 has a beveled lower surface which is complementary to the beveled upper surface of the L-shaped retaining flanges 38 for assembly purposes. The depending bracing flange 76 fits snugly against the upper portion of the inwardly directed flange 54 of the rubber gasket member 48.

Figure 3:
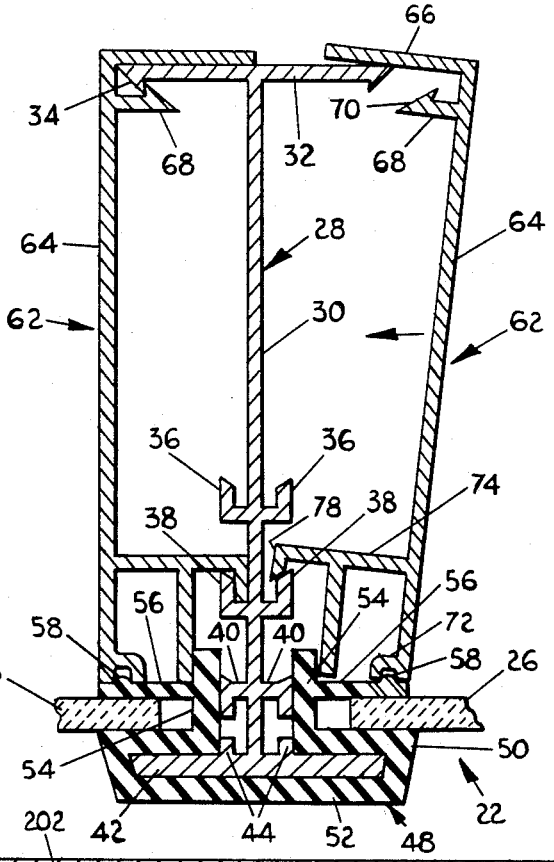
FIG. 3 is a view like FIG. 2 but partially exploded to show a method of attaching a cover retainer to a mullion.

The method of attaching the cover retainer 62 to the vertical inside mullion 28 is illustrated in FIG. 3 to which reference is now made. Initially, the L-shaped flange 72 is placed against the bead 58 with the lateral inner wall 66 separated from the lateral end portion 32 of the mullion 28. The cover retainer 62 is rotated in a counterclockwise direction as viewed in FIG. 3 until the sloping surface of the depending retainer flange 78 bears against the inwardly-sloping surface of the L-shaped retaining flange 38. At this time, the sloping surfaces of the hook portion 70 and the inwardly directed barb 34 will also be in contact as illustrated in FIG. 3. The cover retainer is forced in a counterclockwise direction, with the sloping surface of the depending retainer flange 78 riding over the sloping surface of the L-shaped retaining flange 38. At the same time, the sloping surface of the hook portion 70 rides over the sloping surface of the barb 34 until such time as the hook portion 70 snaps behind the barb 34 and the depending retainer flange 78 drops down behind the L-shaped retaining flange 38. When the cover retainer 62 is thus snap-fit in place, the glass panel 26 will be securely retained within the rubber gasket member 48, the cover member 62 providing an outward force against the laterally directed flange 56. On the other hand, the lateral reinforcing end flange 42 of the mullion 28 prevents the glass panel 26 from moving outwardly. Thus, the glass panels are securely retained in place by the structural gasket system shown in FIG. 2.

Referring now once again to FIG. 2, the left jamb gasket assembly 16 is similar to one-half of the interior vertical gasket assembly 22. Thus, a side mullion 82 has a central web portion 84 with a laterally-extending end portion 86 with an inwardly directed barb 88. The central web portion also has an L-shaped brace 90 and a T-shaped brace 92 on the inner end thereof. Near the other end, the central web portion 84 has L-shaped retaining flanges 94 and 96 and a lateral reinforcing end flange 98, joined to the central web portion 84 through an L-shaped connecting web 102. A retaining groove 100 extends along the outside of the lateral reinforcing end flange 98.

A caulking 104 is positioned between the building frame 24 and the end flange 98. Similarly a caulking 106 is positioned between the building frame 24 and the L-shaped brace 90 of the mullion 82. Packing material for example insulation, is positioned between the frame 24 and the side mullion 82 and is bounded at the outer end by the caulking 104 and at the inner end by the caulking 106.

An edge gasket member 110 has a flat body portion 112, a beaded flange 114 which is positioned within the retaining groove 100 of the side mullion 82. An interior cavity 116 is shaped to correspond and envelop the lateral reinforcing end flange 98. An inwardly directed flange 118 extends inwardly from the body portion 112 and alongside of the L-shaped connecting web 102. A laterally directed flange 120 having a bead 122 extends laterally from the inwardly directed flange 118 along the inner face of the glass panel 26 and has a bead 122 at the inner face thereof. Thus, the lateral flange 120 and the body portion 112 of the edge gasket member 110 form an elongated groove for the glass panel 26.

The side mullion 82 is covered by a cover retainer 62 identical with the cover retainer 62 which covers the vertical inside mullion 28. Further, the cover retainer 62 snap-fits on the mullion 82 and braces the rubber laterally directed flange 120 in the same fashion that the cover 62 snap-fits on the mullion 28 and braces the laterally-directed rubber flange 56.

Figure 4:
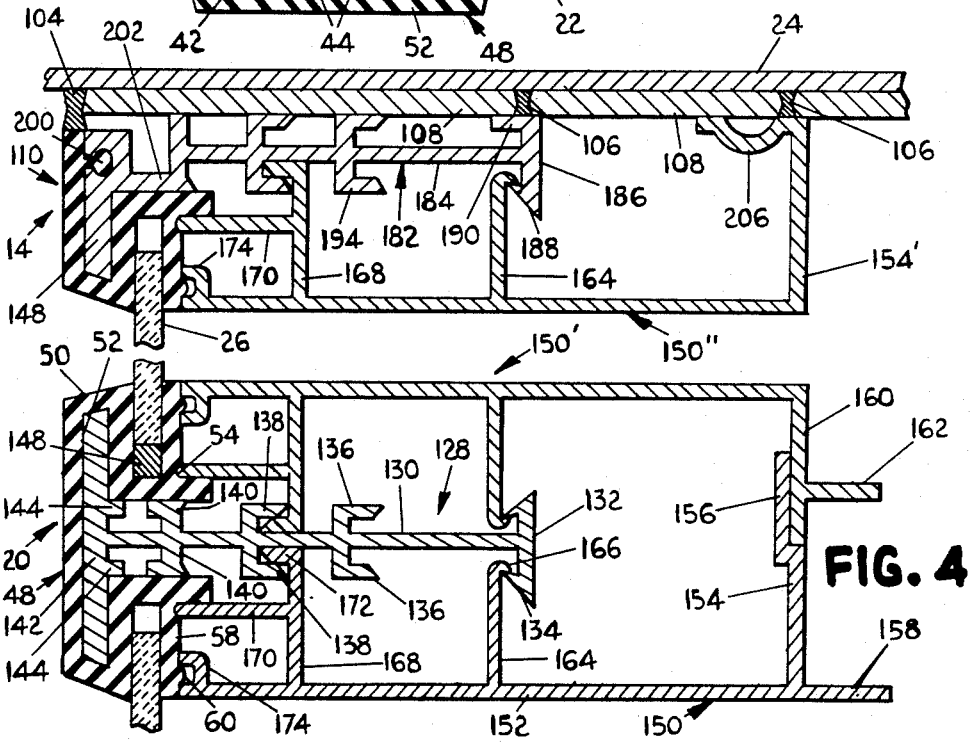
FIG. 4 is a partial sectional view of the wall of FIG. 1 taken along lines 4—4 of FIG. 1.

Referring now to FIG. 4, the structure of the top gasket assembly 14 and the interior horizontal gasket assembly 20 are shown in detail. The top gasket assembly 14 is identical with the bottom gasket assembly 12 except that the bottom gasket assembly 12 is a mirror image of the top gasket assembly 14. Therefore, only the top gasket assembly 14 will be described for purposes of brevity.

The interior horizontal gasket assembly 20 comprises a horizontal mullion 128 which is formed from a central web portion 130, a lateral end portion 132 with inwardly directed barbs 134 on the ends thereof, L-shaped retaining flanges 136, 138, L-shaped bracing flanges 140 and a lateral reinforcing end flange 142 with reinforcing corner flanges 144. The horizontal mullions 128 are joined to the vertical mullions 28 and to the side mullions 82 at the junctures thereof to form a rigid interlocking frame structure. The rubber gasket member 48 used in connection with the vertical mullion 28 is identical with the rubber gasket used with the horizontal mullion 128. Accordingly, like numerals have been used to designate the rubber gasket member 48 and further description of this gasket member will not be made for the sake of brevity.

A spacer block 148 is provided between the inwardly directed flange 54 and the glass panel 26 above each of the horizontal mullions 128. The spacer block 148 is relatively short in length, for example 2–3 inches, and a number of such spacer blocks are used to maintain the bottom of the glass panels 26 a short distance from the inwardly directed flanges 54 of the rubber gasket members 48.

A cover retainer 150 is similar in shape and function to the cover retainer 62 and has a rearwardly-extending wall 152, a lateral inner wall 154 with an offset portion 156 at the end thereof. A rearward shelf 158 extends inwardly beyond the lateral inner wall 154. The cover retainer 150' is similar in construction to cover retainer 150 and forms a complement thereto. The cover retainer 150' has a straight lateral inner wall 160 with an inwardly-extending rearward shelf 162 at one side thereof. Otherwise, the cover retainer 150' is identical with the cover retainer 150. As seen in FIG. 4, the offset portion 156 is juxtaposed to a portion of the straight lateral inner wall 160.

The cover retainers 150 and 150' further comprise a laterally-extending retaining flange 164 having on the end thereof a hook portion 166 for engagement with the inwardly directed barb 134 of the mullion 128. A lateral interior flange 168 has a depending bracing flange 170, the end of which abuts the gasket member lateral flange 56 and has a depending retainer flange 172 which engages the L-shaped retaining flange 138. An L-shaped flange 174 is provided at the outer end of the cover retainer wall 152 to engage the bead 58 on the gasket flange 56.

The cover retainers 150 and 150' function in the same manner as the cover retainer 62. Thus, the cover retainer 150 is first put in place in the manner described for cover retainer 62 and then the cover retainer 150' is put into place.

The top gasket assembly 14 is similar in construction to the left jamb assembly 16 and to the interior horizontal gasket assembly 20. A top or head mullion 182 has a shortened central web portion 184 with a lateral end portion 186 with a retaining flange 188 at the end thereof. An L-shaped brace 190 is positioned at the inner end of the mullion 182. L-shaped retaining flanges 194 and 196 and a lateral reinforcing end flange 198 are provided in similar fashion to corresponding parts for the mullion 128. A keyhole-shaped retaining groove 200 is provided in the outer face of the end flange 198.

The rubber gasket member 110 is used to seal the joint between the glass panel 26 and the mullion 182 in a manner identical with the left jamb gasket assembly described above with respect to FIG. 3. Further description of the rubber gasket is believed unnecessary. In like manner, packing 108 and caulking 104 and 106 are provided between the wall 24 and the mullion 182.

A cover retainer 150'' is identical with the cover retainer 150 except that it has a lateral inner wall 154' with a return flange 206 at the inner end thereof. One of the rubber gaskets 106 abuts the return flange 206. Otherwise, the cover retainer 150'' functions in the same fashion as the cover retainer 150.

The gasket assembly is illustrated in FIG. 4 are the type of system used with interior visible Mullions. In other words, the cover members 150, 150' and 150'' would be considered to be visible from inside the building. In the event that the mullions were covered by an interior wall floor or ceiling, the cover retainers 150, 150' and 150'' can be modified to eliminate that portion of the cover members which extend inwardly (to the left as viewed in Figures) from the retaining flanges 164. Otherwise, the assemblies would be identical.

Figure 5:
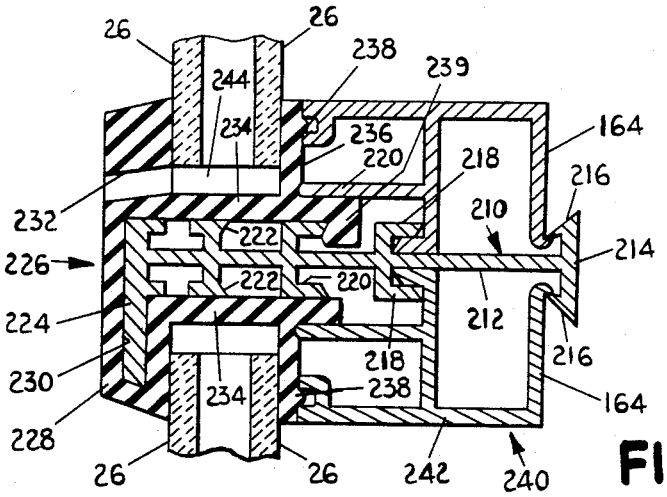
FIG. 5 is a sectional view like FIG. 3 of a double wall panel gasket system.

Referring now to FIG. 5, there is shown a sectional view through a horizontal gasket system in a modified form of the invention in which a pair of glass panels 26 are spaced from each other to provide an insulated panel. In this embodiment, the horizontal mullion 210 is very similar to the horizontal mullion 128 except that a portion of the lateral reinforcing end flange 224 has been removed to provide for a weep passage 232. Thus, the horizontal mullion 210 has a central web 212 with lateral end portions 214 and inwardly directed barbs 216 at the end thereof. L-shaped retaining flanges 218 and 220 and L-shaped bracing flanges 222 are provided along the central web 212. A lateral reinforcing end flange 224 extends down from the end of the web 212. The lateral end flange 224 does not extend upwardly from the end of the web 212 in the drawings but, if desired, the reinforcing end flange 224 can extend upwardly and be broken away at certain portions to allow for passage of water through a weep hole.

A rubber gasket 226 has a flat body portion 228 with an interior cavity 230 corresponding to the end flange 224. A weep passage 232 is provided through an upper portion of the rubber gasket 226 in communication with a space beneath the panels 26. The weep passage 232 allows moisture which condenses within the window to be drained from the gasket system. The glass panels 26 are maintained in spaced relationship from the upper of inwardly directed flange 234 of the rubber gasket 226 by a spacer block 244. The spacer block 244 is as wide as the distance between the outer edges of the two glass panels 26 and is of a length of two to three inches. Numerous spacer blocks are provided to adequately support the windows but the spacer blocks are spaced from each other. Several weep passages 232 can be provided along the length of the rubber gasket 226.

The rubber gasket 226 has inwardly directed flanges 234, laterally directed flanges 236 with a bead 238 on the outer portions thereof. Further, the upper of the inwardly directed flange 234 has a depending retaining flange 239 which fits behind the retaining flange 220 of the mullion 210 to brace the upper part of the rubber gasket 226 against outward forces which may be present on the glass panels 26.

A cover retainer 240, substantially like the cover retainer 150, but somewhat shorter in width, is provided to lock the rubber gasket to the mullion 210. Thus, the cover retainer 240 has a shortened rearwardly-extending wall 242 but is otherwise the same as the cover retainer 150 with respect to the manner in which the retainer is held by the mullion and braces the rubber gasket. The retainer 240 is shown without the walls which extend beyond the retaining flange 164. However, the retainer could have such walls if the joint is an exposed joint. In this case, the gasket assembly has been shown as a concealed joint in the sense that it would otherwise be covered with a floor, an interior wall or a ceiling.

Vertical interior gasket assemblies in accordance with the embodiment shown in FIG. 5 are generally identical and follow the pattern of the gasket assembly shown in FIG. 2 with the modifications shown in FIG. 5. Further, the lateral reinforcing end flange 224 would extend to both sides of the web 212 in the vertical mullions in the fashion of FIG. 2. Generally, when a double glazed window is captured by the gasket assembly, the rubber retainer extends inwardly to accommodate the additional window tickness, the wall (64) of the cover retainer (62) is shorter and the L-shaped retaining flanges 218 rather than, for example, flanges 220, are used for the retainer 62. Otherwise, the system has the same configuration and function.

Figure 6:
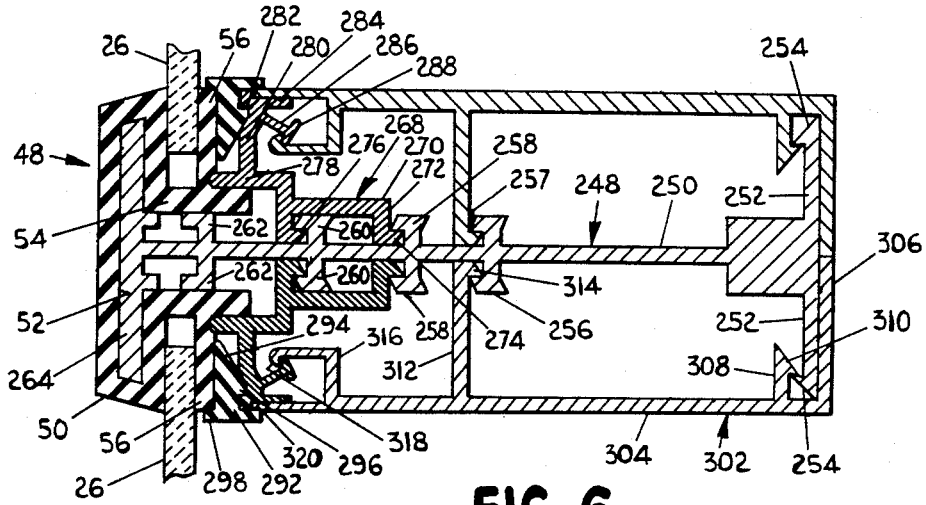
FIG. 6 is a sectional view like FIG. 2 showing a first modified form of the invention.

Referring now to FIG. 6, a modified form of the invention is shown in which a wedging system is used to maintain pressure against the interior side of the glass 26 and thereby clamp the glass tightly between the inner and outer portions of the rubber gasket. The vertical inside mullion 248 has a central web portion 250 with laterally-extending inner end portions 252 and inwardly directed barbs 254 on the ends of end portions 252. L-shaped retaining flanges 256, 258, 260 and L-shaped bracing flanges 262 are spaced along the central web portion 250. Beveled surfaces 257 are provided on the retaining flanges 256, 258 and 260. A lateral reinforcing end flange extends on both sides from the outer end of the web 250.

A rubber gasket member 48, identical with the rubber gasket member 48 shown in FIGS. 1 and 2 except for the bead 58 (FIGS. 2 and 3), is provided to encapsulate the lateral reinforcing end flange 264 and to form a channel for the glass panels 26.

An L-shaped snap-fit spandrel 268 is provided on each side of the mullion 248 to retain the rubber gasket 48 on the glass 26 and on the mullion 248. The spandrel 268 has a leg portion 270 with an L-shaped retaining flange 272. A beveled surface 274 is formed on the end of the retaining flange 272. An L-shaped retaining flange 276 extends from the leg portion 270 and also has an outer beveled surface. A reinforcing flange 278 extends along the inner portion of the inwardly directed flange 54 of the gasket member 48. Leg portion 280, having a recessed groove 282, extends laterally from the reinforcing flange 278 and a guide flange 284 extends rearwardly along the end of leg portion 280. Further, an L-shaped retaining flange 286 extends at about a 45° angle to the leg portion 280 and has an outer angled guide surface 288.

A wedge 292 has a forward sloping guide surface 294, a locking bead 296 and an end flange 298. The wedge 292 can be made out of hard rubber, and provides a very strong biasing force between the spandrel 268 and the rubber gasket member flange 56. The spandrels 268, on the other hand, press tightly against the mullion 248 from both sides thereof. Thus, the wedge 292 provides a very tight joint between the panel 26 and the rubber gasket member 48.

A pair of covers 302 have a rearwardly-extending wall 304, lateral inner wall 306, retaining flange 308 with a hook portion 310 at the end thereof. The hook portion 310 engages the inwardly directed barb 254 of the lateral end portion 252 of the mullion 248. The hook portion 310 as well as the inwardly directed barb 254 have beveled surfaces which are at approximately a 45 angle with respect to the planes of the retaining flange 308 and the lateral end portion 252, respectively.

A lateral interior flange 312 extends from the wall 304 and has a retaining flange 316 at the end thereof. A beveled surface is also provided on the end of the hook portion 314 which engages and is retained by the L-shaped retaining flanges 256.

An L-shaped retaining flange 316 having a hook 318 on the end thereof engages the L-shaped retainer flange 286. The end of wall 304 is positioned against the guide flange 284 of the spandrel 268.

Figure 7:
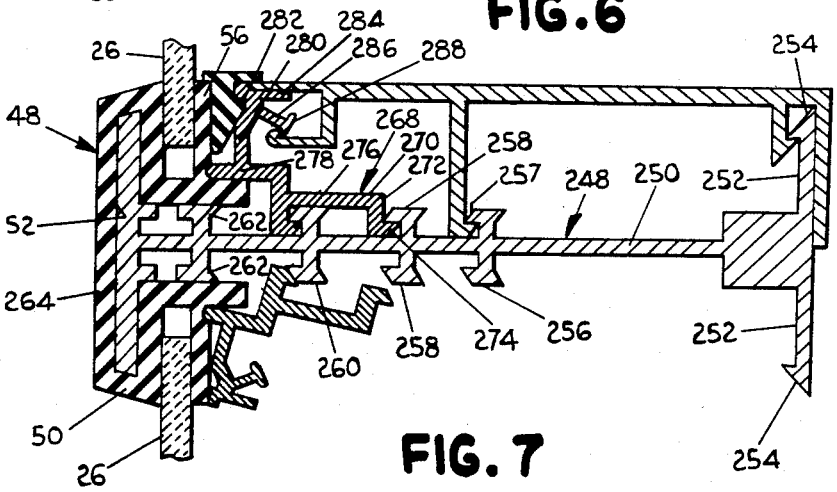
FIG. 7 is a view of the gasket wall system shown in FIG. 6 but partially exploded to illustrate the manner in which the spandrel snaps onto the mullion.

The manner in which the spandrel 268 is connected to the mullion 248 is shown in FIG. 7 to which reference is now made. The spandrels 268 are first attached to the mullions 248 before the wedges 292 are put in place. First, the beveled surfaces 257 of the L-shaped retaining flanges 256 and 258 are mated with the beveled surfaces on the L-shaped retaining flanges 272 and 276 respectively. The spandrel 268 is forced towards the mullion 248 until the flanges engage as illustrated in FIG. 6. The rubber gasket 48 is somewhat resilient so as to allow the retaining flanges of the spandrel to snap over the retaining flanges of the mullion 248.

Figure 8:
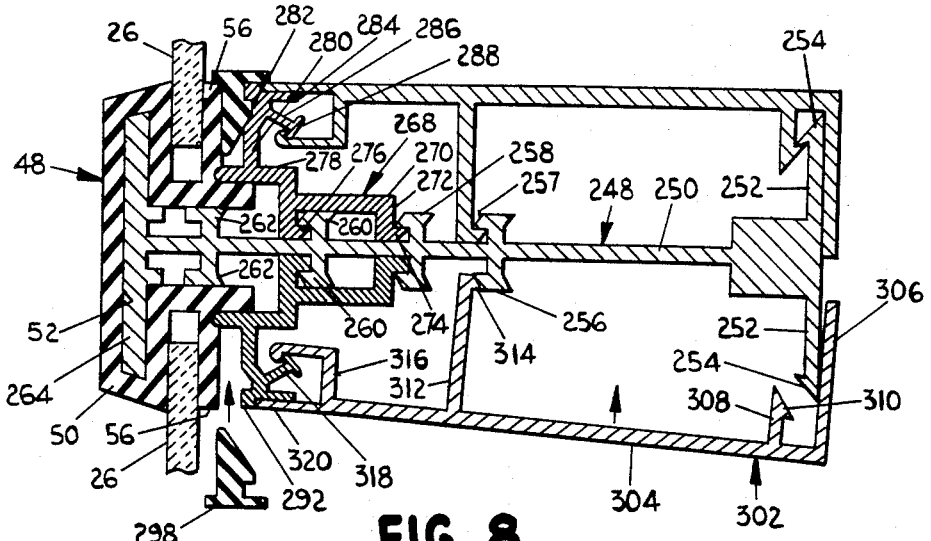
FIG. 8 is a view of the structural gasket system seen in FIG. 6 but partially exploded to show the manner in which the cover snaps onto the mullion and spandrel.

The manner in which the cover 302 is snap-fit in place on the spandrel 268 and the mullion 248 is illustrated in FIG. 8 to which reference is now made. Subsequent to installation of the spandrels 268 to the mullions 248, the covers 302 are applied. The beveled surfaces of the hook portion 310 and the barb 254 are placed in contact with each other. At the same time, the beveled surfaces of the cover hook portion 314 are placed in contact with the beveled surface 257 of the retaining flange 256. Simultaneously, the cover hook 318 is placed onto the spandrel angled guide surface 288. The cover is then forced toward the spandrel and toward the panels 26 in the direction of the arrow illustrated in FIG. 8 until the cover engages the spandrel and the mullion in the manner illustrated in FIG. 6. Subsequent to installation of the covers as described above, the wedges 292 are forced in place, with the wedge locking bead 296 fitting into the spandrel recessed groove 282.

The system shown in FIGS. 6 through 8 is of an interior vertical gasket assembly. The horizontal, right jamb, left jamb, bottom and top gasket assemblies would be constructed similarly with the same type of differences as exist between the vertical gasket assembly illustrated in FIG. 2 and the jamb, top and horizontal gasket assemblies illustrated in FIGS. 2 and 3.

Figure 9:
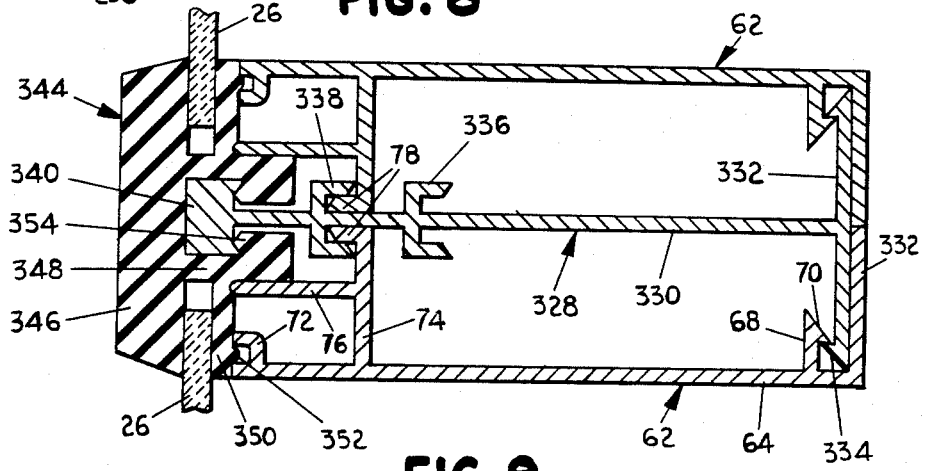
FIG. 9 is a sectional view like FIG. 2 showing a second modified form of a gasket system according to the invention.

FIG. 9 illustrates a modified form of the invention in which no mullion retaining flanges are outside of the glass panels 26. Thus, a vertical inside mullion 328 has a central web portion 330 with lateral end portions 332 having inwardly directed barbs 334 at the ends thereof. L-shaped retaining flanges 336 and 338 are positioned along the web 330 and an enlarged end portion 340 is formed at the outer end of the web 330. The outer surface of end portion 340 is coextensive with the outer edge of the glass panel 26.

A rubber gasket member 344 has a flat body portion 346, inwardly directed flanges 348 and laterally-directed flanges 350 with beads 352 near the ends thereof. A laterally extending retainer portion 354 of the rubber gasket 344 extends over the enlarged end portion 340.

A cover retainer 62 is secured to the mullion 328 in the same fashion that the cover 62 is secured to the mullion 28. Further, the cover retainer 62 interacts with the gasket 344 in the same manner as the cover 62 interacts with the rubber gasket member 48. Further discussion of the cover member 62 is believed unnecessary.

Although only the vertical gasket assembly is illustrated in FIG. 9, horizontal gasket assemblies and top, bottom, leg jamb and right jamb gasket assemblies of similar ilk are used with the structure shown in FIG. 9. The relationship between the different gasket assemblies in the embodiment shown in FIG. 9 is the same as the relationships between the different gasket assemblies illustrated in the embodiments of FIGS. 2 and 3.

Figure 10:
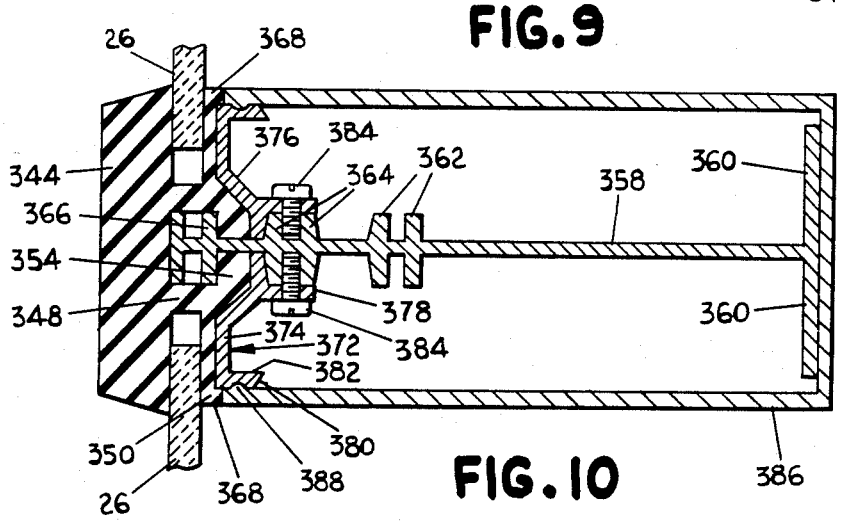
FIG. 10 is a view like FIG. 2 showing a third modified form of the gasket system according to the invention.

Reference is now made to FIG. 10 for still another embodiment of the invention. This embodiment is similar to the embodiment illustrated in FIG. 9 in the sense that the mullion does not have a portion which extends beyond the outside surface of the glass panels 26. However, the gasket system of FIG. 10 contemplates a screw-fastened retainer between the mullion and the gasket to thereby firmly grip the panels 26 and provide a tight coupling between the rubber gasket and the mullion.

The vertical inside mullion 358 has lateral end portions 360 and parallel retaining flanges 362, 364 and parallel end flanges 366. The gasket 344 is identical with the gasket 344 illustrated in FIG. 9 except that an additional retaining lip 368 is provided on the outer end of the laterally directed flange 350. Thus, the laterally-extending retainer portions 354 extend over and capture the parallel end flanges 366 of the mullion 358.

A retainer 372 has a flat base portion 374 which extends along the gasket flange 350 and braces the same against the interior surface of the glass panel 26. The retainer 372 has a raised inner end 376 with an attaching flange 378 extending rearwardly therefrom. A corner-receiving flange 380 extends rearwardly from the outer end of the base 374. An exterior recessed groove 382 is provided in the corner-receiving flange 380. A screw 384 extends through a hole in the attaching flange 378 and is threadably received between the side walls of the parallel retaining flanges 364. The retainer 372 is so shaped that when the screw attaches the retainer to the mullion, outward pressure will be applied by the base 374 against the gasket flange 350.

A U-shaped cover 386 having beads 388 snap-fits over the mullion 358 with the cover beads 388 snapping into the retainer groove 382. The cover 386 is principally cosmetic and does not contribute otherwise to the gasket system.

In the event that a double glazed window, as for example illustrated in FIG. 5, is used with this system, the same retainer 372 is used and the screws 384 are threaded into the parallel retaining flanges 362. The rubber gasket 334, however, is modified in the same fashion as the gasket 226 (FIG. 5) to accommodate the spaced-apart panels.

Figure 11:
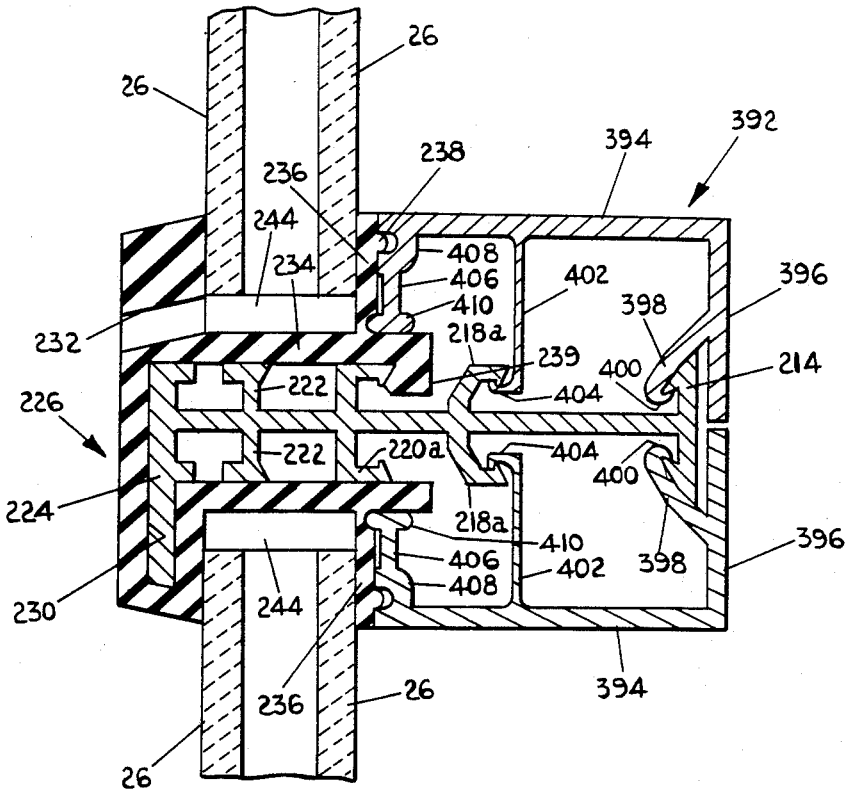
FIG. 11 is a vertical sectional view, like FIG. 5 of a fourth modification of the invention.

Reference is now made to FIG. 11 for a description of a fourth embodiment of the invention. This embodiment is similar to FIG. 2 and like numerals are used to designate like parts. In FIG. 11, there is shown a vertical sectional view through a horizontal gasket system in which a pair of glass panels 26 are spaced from each other to provide an insulated panel. The horizontal mullion 210 is similar to the horizontal mullion 210 illustrated in FIG. 5 except that the lateral retaining flange 218*a* is beveled somewhat and has a hooked portion on the end thereof. The lateral flange 220*a* also has a hooked or barbed retaining flange. The lateral end flange 224 does not extend upwardly from the end of the web 212 in the drawing but, if desired, the retaining end flange 224 can extend upwardly and be slotted at certain portions to allow for passage of water through a weep hole.

A rubber gasket 226 has a flat body portion 228 with an interior cavity 230 corresponding to the end flange 224. A weep passage 232 is provided through an upper portion of the rubber gasket 226 in communication with a space beneath the panels 26. The weep passage 232 allows moisture which condenses within the window panels 226 to be drained from the gasket system. The glass panels 226 are maintained in spaced relationship from the upper of the inwardly directed flange 234 of the rubber gasket 226 by a spacer block 224. A like spacer block 224 can be positioned on top of the glass panels 26 as well.

The rubber gasket 226 has inwardly directed flanges 234, laterally directed flanges 236 with a bead 238 on the outer portions thereof. Further, the upper of the inwardly directed flange 234 has a depending retaining flange 239 which fits behind the retaining flange 220*a* of the mullion 210 to brace the upper part of the rubber gasket 226 against outward forces which may be present on the glass panel 26.

A cover retainer 392 like the cover retainer 240 is provided to lock the rubber gasket to the mullion 210. The cover retainer 392 has a rearwardly-extending wall 394, a lateral rear wall 396 with a retaining flange 398 with a hooked portion or barb 400 at the end thereof. A central retaining flange 402 extends laterally from the rearwardly extending wall 394 and has a hooked portion 404 on the end thereof. An outer retaining flange 406 extends laterally from the front portion of the wall 394 and has a grooved portion 408 and a bracing perpendicular portion 410. The bead 238 of the laterally directed flange 236 is received within the slot or groove of the grooved portion 408. The bracing perpendicular portion 410 fits snugly against the inwardly directed flange 234 and braces the same against the mullion retaining flange 220*a*. Note that the enlarged end portion 239 of the flange 234 is captured and retained between the bracing perpendicular portion 410 of the cover retainer 392 and the mullion retaining flange 220*a*.

The assembly of the gasket assembly shown in FIG. 11 is substantially the same as the assembly shown in FIG. 5. The cover retainer 392 snaps in place onto the mullion 210 and thereby locks the rubber gasket 226 in position to capture the glass panels 26.

The vertical gasket assembly is substantially identical to that shown in FIG. 11 except that the vertical mullion has a lateral reinforcing end flange 224 extending from either side thereof and the rubber gasket 226 has an interior cavity 230 to accommodate the shape of the mullion. Further, no weep hole is provided in the vertical sections of the gasket.

It thus can be seen from the foregoing that the same basic structure of mullions can be used regardless of whether single or double glazed windows are employed and all assemblies can take place from the interior of the building, thereby reducing significant labor costs.

The gasket system of the invention is installed by first securing the mullion in a rigid framework to an interior fixed structural member. The mullions are joined together at the inner sections thereof. The gasket members are then positioned on the mullions. Typically, the corner sections of the gaskets will be molded at the factory to avoid leakage at the corners of the gasket system. The straight sections of the gasket will also be molded at the factory to fit the particular mullion employed. When the straight sections connect with the corner sections, a seal must be made at the joints. Thereafter, the glass panels are positioned in place from the inside of the building with the inner lips of the gasket members being flexible to allow insertion of the glass panels. The outer lips of the gasket system are rigid enough to prevent the glass from falling outwardly. The retainers are then secured to the mullion, thereby locking the gaskets to the mullion and thereby forcing the gasket inner lips against the glass panels to seal the gasket to the panels. Thereafter, the cover, if any, is secured in place around the mullion and retainer.

Thus, the invention provides for a very effective, insulated structural gasket system, yet one which can be substantially manufactured under quality control conditions in the factory, easily installed in the field from within the building in a simply and expeditious manner.

Whereas the invention has been described with reference to certain walls in which glass substantially covers the outside of a building, the invention is also applicable to walls which contain less than full walls of glass or other panels. For example, the invention can be used for ribbon windows, punched openings and strip windows. In such case, the window frame would be formed with edge gaskets and mullions and horizontal or vertical mullions would be spaced along the length or height of the opening. Otherwise, the gasket assembly would be the same.

Reasonable variation and modification are possible within the scope of the foregoing disclosure and drawings without departing from the spirit of the invention which is defined in the apended claims.

The embodiments of the invention in which an exclusive property or privilege is claimed are defined as follows:

1. A structural gasket system for an exterior wall comprising a plurality of panels having a width and length in planar juxtaposed relationship supported by an interior fixed structural member, the structural gasket system comprising:

a rigid structural framework formed by intersecting metal mullions which are joined together at intersections thereof and secured to said interior fixed structural member, each of said mullions having gasket-engaging means at an outer end thereof and a retainer-engaging means inwardly of the outer end thereof;

an elastomeric gasket member having a one piece molded portion surrounding and contacting the gasket-engaging means of said mullion, extending along said mullion inwardly of said panels, having an outer laterally-extending body portion and an inner laterally-extending flange forming channels the width of said panels inwardly of at least the outer end of said gasket-engaging means of said mullions for capturing edge portions of said panels; and retainer means between each side of said mullion and said gasket, said retainer means having means to grip said retainer-engaging means and being so shaped so as to engage said one piece molded portion to lock said gasket member onto said mullion and to force the gasket inner flange against an edge portion of a panel within the channels formed in said elastomeric gasket member.

2. The structural gasket system according to claim 1 wherein said gasket-engaging means of said mullions comprises a T-shaped outer end positioned outside of said panels and with portions of said T-shape extending laterally beyond the edge of said panels.

3. The structural gasket system according to claim 2 wherein said retainer-engaging means of said mullion comprises L-shaped flanges which extend inwardly; and laterally-extending flanges at an inner end of said mullion to capture said retainer means between an L-shaped flanges and the laterally-extending flanges.

4. The structural gasket system according to claim 3 wherein said mullion has an I-beam shape with said L-shaped flanges positioned in a central portion of said beam shape.

5. The structural gasket system according to claim 3 wherein said retainer means and the inner flange of said gasket member have interengaging means to maintain the inner flange in its laterally-extending position along the inner face of said panels in said gasket-member channels.

6. The structural gasket system of claim 5 wherein said retainer means and said mullion laterally-extending flanges have interengaging means which provide a snap-fit connection therebetween.

7. The structural gasket system according to claim 6 wherein said retainer means have an outwardly-extending flange which is captured by one of said mullion L-shaped flanges and the ends of said outwardly-extending flanges and said mullion L-shaped flanges have complementary beveled surfaces to facilitate assembly of said retainer means to said mullion.

8. The structural gasket system according to claim 3 wherein there are multiple sets of L-shaped flanges spaced along a central portion of said mullion to accommodate different thickness panels.

9. The structural gasket system according to claim 3 wherein said retainer means and said mullion laterally-extending flanges have interengaging members which provide a snap-fit connection therebetween.

10. The structural gasket system according to claim 3 wherein said retainer means has an outwardly-extending flange which is captured by one of said mullion L-shaped flanges and the ends of said outwardly-extending flanges and said mullion L-shaped flanges have complementary beveled surfaces to facilitate assembly of said retainer means to said mullion.

11. The structural gasket system according to claim 2 wherein said retainer-engaging means on said mullion comprises L-shaped flanges extending in an outward direction and said retainer means comprises:

a first rigid member which extends between at least one of said mullion L-shaped flanges and said gasket member along said mullion and having a lateral flange spaced from said gasket inner lip;

a wedge member having a tapered surface positioned between said lateral flange of said first rigid member and said inner lip of said gasket member, said wedge member applying pressure to said gasket inner lip; and means for locking said wedge member to said first rigid member.

12. The structural gasket according to claim 11 wherein said gasket member has an inwardly directed flange which extends along said mullion and said first rigid member has a flange which extends along said gasket inwardly directed flange to maintain the same in contact with said mullion.

13. The structural gasket system according to claim 11 and further comprising a cover member to cover said mullion and said retainer means and interengaging means between said cover member, said mullion and said retainer means to lock said cover member to said mullion.

14. The structural gasket system according to claim 13 wherein said interengaging means comprises a laterally directed flange on said cover member with a hook on the end thereof engaging one of said mullion L-shaped flanges, a laterally-extending flange on the inner end of said mullion with a hook on the end thereof, a laterally-extending flange on said cover with a hook on the end thereof for engaging the hook on said mullion laterally-extending flange.

15. The structural gasket system according to claim 2 wherein said retainer-engaging means comprises threaded screw-retaining flanges in a central portion of said mullion and said means to engage said retainer-engaging means comprises threaded fasteners which extend through said retainer means and are threaded into said screw-receiving flanges.

16. The structural gasket system according to claim 15 and further comprising a cover for said mullion and said retainer means, and snap-fit engaging means between said cover and said retainer to hold said cover onto said retainer.

17. The structural gasket system according to claim 1 wherein said gasket-engaging means of said mullion comprises an enlarged end portion which is coextensive with said panels.

18. The structural gasket system according to claim 17 wherein said retainer-engaging means of said mullion comprises L-shaped flanges which extend rearwardly and laterally-extending flanges at an inner end of said mullion to capture said retainer means between the L-shaped flanges and the laterally-extending flanges.

19. The structural gasket system according to claim 18 wherein said retainer means and said inner lip of said gasket member have interengaging means to maintain the inner lip in its relatively extending position along the inner face of panels in said gasket member channels.

20. The structural gasket system according to claim 19 wherein said retainer means and said mullion laterally-extending flanges have interengaging means which provide a snap-fit connection therebetween.

21. The structural gasket system according to claim 20 wherein said retainer means have an outwardly-extending flange which is captured by one of said mullion L-shaped flanges, and the ends of said outwardly-extending flanges and said mullion L-shaped flanges have complementary beveled surfaces to facilitate assembly of said retainer means to said mullion.

22. The structural gasket system according to claim 18 wherein there are multiple sets of L-shaped flanges spaced along a central portion of said mullion to accommodate different thickness panels.

23. The structural gasket system according to claim 18 wherein said retainer means and said mullion laterally-extending flanges have interengaging means which provide a snap-fit connection therebetween.

24. The structural gasket system according to claim 18 wherein said retainer means have an outwardly-extending flange which is captured by one of said mullion L-shaped flanges and the ends of said outwardly-extending flanges and said mullion L-shaped flanges have complementary beveled surfaces to facilitate assembly of said retainer means to said mullion.

25. The structural gasket system according to claim 17 wherein said retainer-engaging means on said mullion comprises L-shaped flanges extending in an outward direction and said retainer means comprises:

a first rigid member which extends between at least one of said mullion L-shaped flanges and said gasket member along said mullion and having a lateral flange spaced from said gasket inner lip;

a wedge member having a tapered surface positioned between said lateral flange of said first rigid member and said inner lip of said gasket member, said wedge member applying pressure to said gasket inner lip; and means for locking said wedge member to said first rigid member.

26. The structural gasket system of claim 25 wherein said gasket member has an inwardly directed flange which extends along said mullion and said first rigid member has a flange which extends along said gasket member inwardly directed flange to maintain the same in contact with said mullion.

27. The structural gasket system according to claim 25 and further comprising a cover member to cover said mullion and said retainer means, and interengaging means between said cover member, said mullion and said retainer means to lock said cover member to said mullion.

28. The structural gasket system according to claim 27 wherein said interengaging means comprises a laterally directed flange on said cover member with a hook on the end thereof engaging one of said mullion L-shaped flanges, a laterally-extending flange on the inner end of said mullion with a hook on the end thereof, a laterally-extending flange on said cover with a hook on the end thereof for engaging the hook on said mullion laterally-extending flange.

29. The structural gasket system according to claim 17 wherein said retainer-engaging means comprises threaded screw-receiving flanges in a central portion of said mullion, said means to engage said retainer-engaging means comprises threaded fasteners which extend through said retainer means and are threaded into said screw-receiving flanges.

30. The structural gasket system according to claim 29 and further comprising a cover for said mullion and said retainer means, and snap-fit engaging means between said cover and said retainer to hold said cover onto said retainer means.

31. The structural gasket system according to claim 1 wherein said panels are a double-glazed panel and said gasket has a plurality of weep holes extending from said channels to the outside of said gasket in horizontal portions of said gasket system to drain moisture which may form between said panels.

* * * * *